US009845668B2

(12) United States Patent
Ryan et al.

(10) Patent No.: US 9,845,668 B2
(45) Date of Patent: Dec. 19, 2017

(54) SIDE-WELL INJECTION AND GRAVITY THERMAL RECOVERY PROCESSES

(71) Applicant: CONOCOPHILLIPS COMPANY, Houston, TX (US)

(72) Inventors: Kate M. Ryan, Arvada, CO (US); Thomas J. Wheeler, Houston, TX (US); John L. Stalder, Cypress, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 13/911,542

(22) Filed: Jun. 6, 2013

(65) Prior Publication Data

US 2013/0333884 A1 Dec. 19, 2013

Related U.S. Application Data

(60) Provisional application No. 61/659,569, filed on Jun. 14, 2012.

(51) Int. Cl.
*E21B 43/24* (2006.01)
*E21B 43/30* (2006.01)

(52) U.S. Cl.
CPC ..... *E21B 43/2406* (2013.01); *E21B 43/305* (2013.01)

(58) Field of Classification Search
CPC ..... E21B 43/16; E21B 43/24; E21B 43/243; E21B 43/247
See application file for complete search history.

(56) References Cited

U.S. PATENT DOCUMENTS

| | | | | |
|---|---|---|---|---|
| 3,847,219 | A | 11/1974 | Wang et al. | |
| 4,008,764 | A | 2/1977 | Allen | |
| 4,161,217 | A | 7/1979 | Dilgren et al. | |
| 4,344,485 | A | 8/1982 | Butler | |
| 4,598,770 | A * | 7/1986 | Shu et al. | 166/245 |
| 4,607,699 | A | 8/1986 | Stephens | |
| 4,967,837 | A | 11/1990 | Danzik | |

(Continued)

FOREIGN PATENT DOCUMENTS

| | | |
|---|---|---|
| EP | 1738058 | 4/2008 |
| GB | 2205122 | 11/1988 |

(Continued)

OTHER PUBLICATIONS

International Search Report (PCT Article 18 and Rules 43 and 44) dated Oct. 18, 2013. Form PCT/ISA/210 (dated Jul. 2009).

*Primary Examiner* — Shane Bomar
(74) *Attorney, Agent, or Firm* — ConocoPhiillips Company

(57) ABSTRACT

Methods and systems relate to recovering hydrocarbons with an injection well placed at a bottom of a reservoir some horizontal distance from a producer, such that the injection well and producer may both be in a common horizontal plane. For some embodiments, the process includes co-injection of steam with a non-condensable gas, such as methane, ethane, propane, carbon dioxide, combustion products and combinations thereof. The non-condensable gas provides additional solution gas drive while the location of the injection well beside, instead of above, the producer increases production time before a steam chamber reaches a top of the reservoir, increasing thermal and recovery efficiency of the process.

18 Claims, 2 Drawing Sheets

(56) References Cited

U.S. PATENT DOCUMENTS

| | | | | |
|---|---|---|---|---|
| 5,005,644 | A | 4/1991 | Wall et al. | |
| 5,046,559 | A | 9/1991 | Glandt | |
| 5,626,191 | A | 5/1997 | Greaves et al. | |
| 6,050,335 | A | 4/2000 | Parsons | |
| 8,474,531 | B2 | 7/2013 | Nasr et al. | |
| 2005/0211434 | A1 | 9/2005 | Gates et al. | |
| 2007/0181299 | A1 | 8/2007 | Bose et al. | |
| 2007/0193748 | A1* | 8/2007 | Ware et al. | 166/303 |
| 2008/0017372 | A1 | 1/2008 | Bunio et al. | |
| 2009/0178806 | A1 | 7/2009 | Fraim | |
| 2010/0206563 | A1 | 8/2010 | Sarathi et al. | |
| 2010/0326656 | A1 | 12/2010 | Menard | |
| 2011/0017455 | A1 | 1/2011 | Duong | |
| 2011/0120709 | A1 | 5/2011 | Nasr et al. | |
| 2011/0120710 | A1 | 5/2011 | Dong et al. | |
| 2012/0061080 | A1 | 3/2012 | Sultenfuss et al. | |
| 2012/0292055 | A1* | 11/2012 | Swist | 166/401 |
| 2013/0213652 | A1* | 8/2013 | Stalder | 166/272.3 |
| 2014/0345859 | A1* | 11/2014 | Canas | 166/256 |

FOREIGN PATENT DOCUMENTS

| | | |
|---|---|---|
| WO | 2008009114 | 1/2008 |
| WO | 2008011704 | 1/2008 |

* cited by examiner

SIDE-WELL INJECTION AND GRAVITY THERMAL RECOVERY PROCESSES

CROSS-REFERENCE TO RELATED APPLICATIONS

This application is a non-provisional application which claims benefit under 35 USC §119(e) to U.S. Provisional Application Ser. No. 61/659,569 filed Jun. 14, 2012, entitled "Side-Well Injection And Gravity Thermal Recovery Processes," which is incorporated herein in its entirety.

STATEMENT REGARDING FEDERALLY SPONSORED RESEARCH OR DEVELOPMENT

None

FIELD OF THE INVENTION

Embodiments of the invention relate to methods and systems for recovering oil, which is recovered utilizing steam injection into a hydrocarbon-bearing formation.

BACKGROUND OF THE INVENTION

Steam assisted gravity drainage (SAGD) involves two horizontal wells, one acting as an injector and the other as a producer. The producing well is located at the bottom of the formation and the injecting well is approximately 5 meters above. As bitumen becomes mobilized, force of gravity along the walls of a resulting steam chamber induces the flow of the bitumen into the producing well.

Although the SAGD process is currently commercially successful in some applications, many limitations restrict economic viability of the process. One area where traditional SAGD is limited is in thin bitumen reservoirs (e.g., less than 10 meters in thickness). Costs associated with such processes require sufficient reservoir thickness to make recovery of the oil economically viable.

In thinner reservoirs the steam chamber reaches the top of the reservoir very early in the production process. Once the steam chamber reaches the top of the reservoir it begins to lose heat to the overburden. This heat loss reduces the thermal efficiency of the process.

Therefore, a need exists for improved methods and systems for recovering of oil obtained from steam injection based operations.

BRIEF SUMMARY OF THE DISCLOSURE

In one embodiment, a method of producing hydrocarbons includes forming an injection well in a formation and having an injector section that extends lengthwise towards horizontal. A production well in the formation includes a producer section that extends lengthwise towards horizontal laterally offset and in horizontal alignment with the injector section. Introducing steam and a gas non-condensable under reservoir conditions into the formation through the injection well forms a steam chamber above the injector section and enables producing the hydrocarbons through the production well by combined gravity drainage and pressure drive from the gas.

For one embodiment, a method of producing hydrocarbons includes forming in a formation an injection well with a horizontal injector section and a production well with a producer section that extends parallel to the injector section without vertical offset from the injector section. Introducing steam and a gas non-condensable under reservoir conditions into the formation through the injection well forms a steam chamber above the injector section. The method further includes producing the hydrocarbons through the production well by combined gravity drainage and pressure drive from the gas.

BRIEF DESCRIPTION OF THE DRAWINGS

A more complete understanding of the present invention and benefits thereof may be acquired by referring to the following description taken in conjunction with the accompanying drawings.

DETAILED DESCRIPTION

In some embodiments, a process includes a carbon dioxide ($CO_2$) and steam co-injection well placed at a bottom of a reservoir some horizontal distance from a producer, such that the injection well and producer may both be in a common horizontal plane. For some embodiments, the process includes such relocating of the injection well and the co-injection of steam with a non-condensable gas such as methane, ethane, propane, carbon dioxide, combustion gases from direct steam generation and combinations thereof. The non-condensable gas provides additional solution gas drive while the relocation of the injection well beside, instead of above, the producer increases production time before a steam chamber reaches a top of the reservoir, increasing thermal and recovery efficiency of the process.

Figure 1:
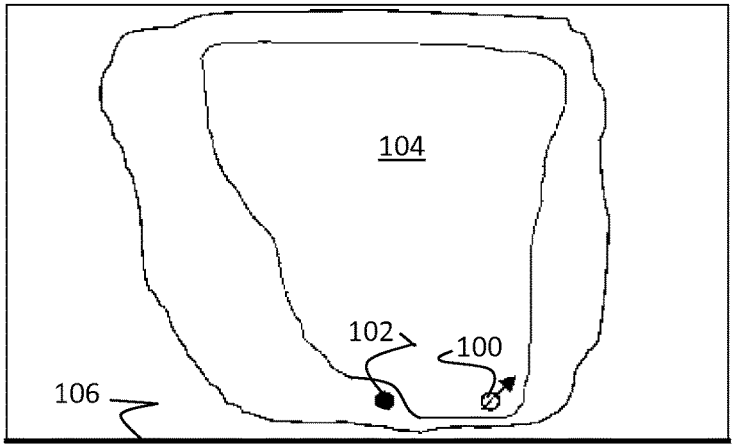
FIG. 1 is a schematic of a well pair configuration, according to one embodiment of the invention.

FIG. 1 illustrates an injector well 100 that includes a horizontal length forming an injector section disposed parallel to a horizontal length forming a producer section of a producer well 102. Location of the injector well 100 disposes the injector section laterally offset and in horizontal alignment or at a common depth with the producer section of the producer well 102. This placement achieves a steam trap with such lateral offset without vertical offset between the injector well 100 and the producer well 102.

The wells 100, 102 traverse through an earth formation containing petroleum products, such as heavy oil or bitumen that may have an initial API gravity less than 25°, less than 20°, or less than 10°. In some embodiments, the wells 100, 102 form a well pair operable for gravity drainage without relying on any other wells. The wells 100, 102 may be disposed within 0 to 10 meters, 5 to 15 meters, 0 to 100 meters of one another and thus be separated from any other wells in the reservoir by more than 100 meters. The wells 100, 102 may also be connected with open hole fishbones, allowing for accelerated communication during the start-up of the SAGD process.

In operation, a steam chamber 104 forms as thermal fluid is supplied through the injector well 100 and products are recovered from the producer well 102. The chamber develops above a bottom 106 of the reservoir. The injector well 100 and the producer well 102 may be disposed with the horizontal lengths near or within 5 meters of the bottom 106 of the reservoir, which in some embodiments is less than 10, 15, 20 or 25 meters thick.

Relative to conventional SAGD, the distance from the injector well 100 to a top of the reservoir increases, for example by 5 meters. The injector well 100 disposed toward the bottom 106 of the reservoir increases the amount of time for the steam chamber 104 to come into contact with the overburden. This additional time increases the thermal efficiency by facilitating energy transfer to the bitumen.

The increased height of the steam chamber 104 caused by location of the injector well 100 also helps to induce higher oil production rates. In particular, rates are proportional to the square root of the height of the chamber 104. These higher oil rates lead to lower instantaneous steam-oil ratios and higher economic cumulative oil production.

The location of the injector well 100 changes the temperature profile of the steam chamber 104 relative to conventional SAGD. This change in temperature profile provides lower temperatures at the overburden interface. Lower temperatures help limit the amount of energy that is lost to the overburden.

In some embodiments, the injector well 100 supplies a mixture of both steam and non-condensable gas under reservoir conditions. Examples of the non-condensable gas include carbon dioxide, flue combustion gases and methane. The solubility of the non-condensable gases in bitumen causes a reduction in the viscosity of bitumen. This additional viscosity reduction coupled with the reduction from the steam injection further mobilizes the oil and increases the oil production rates.

Some of the non-condensable gas mixes with the gaseous steam to form the chamber 104. However, some of the non-condensable gas permeates through the bitumen and creates a gas override. The hot gas permeating through the system functions as an additional recovery mechanism via gas solution pressure drive.

In the conventional SAGD well configuration, solvents and gases injected with the steam are not likely to contact the bitumen located below the level of the producer in the reservoir because these components are either immediately produced or are re-vaporized before being produced. However, the injector well 100 due to being laterally offset causes immediate gravity segregation of the vapors from the condensing steam and the non-condensable gas within the bitumen due to gravity override of the vapor. Such portion of injected fluids that drop out in liquids have more interaction area and contact time with the underlying bitumen before reaching the producer well 102. To the extent that the non-condensable gas is soluble in the bitumen, the bitumen density can be lightened. While the bitumen is often slightly denser than water at reservoir conditions, minor amounts of the non-condensable gas dissolving into the bitumen can make the bitumen less dense than water. Combination of lateral displacement of the injector well 100 and such gravity inversion may result in "floating" deeper bitumen that would otherwise not be produced.

Figure 2:
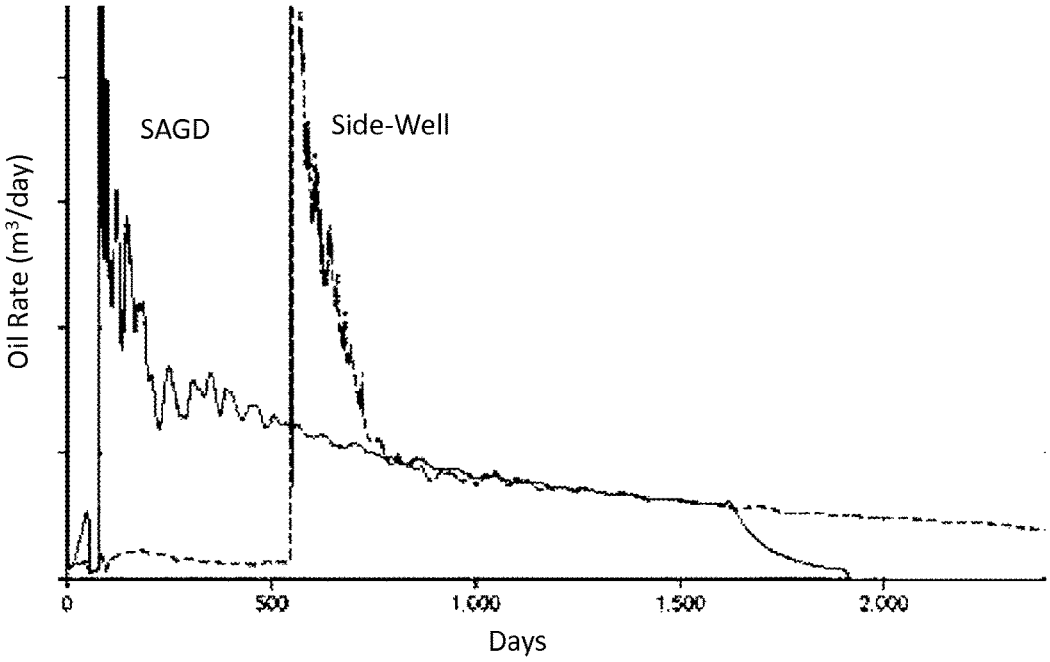
FIG. 2 is a graph showing simulated oil production rate utilizing the well pair configuration compared to a conventional SAGD pair with vertical offset between injection and production wells, according to one embodiment of the invention.

FIG. 2 illustrates simulated oil production provided by side-well approaches described herein relative to conventional SAGD. To facilitate comparison, the side-well start time is offset 500 days after the SAGD start time. The side-well provides a similar curve for oil rate of recovery as the SAGD.

Figure 3:
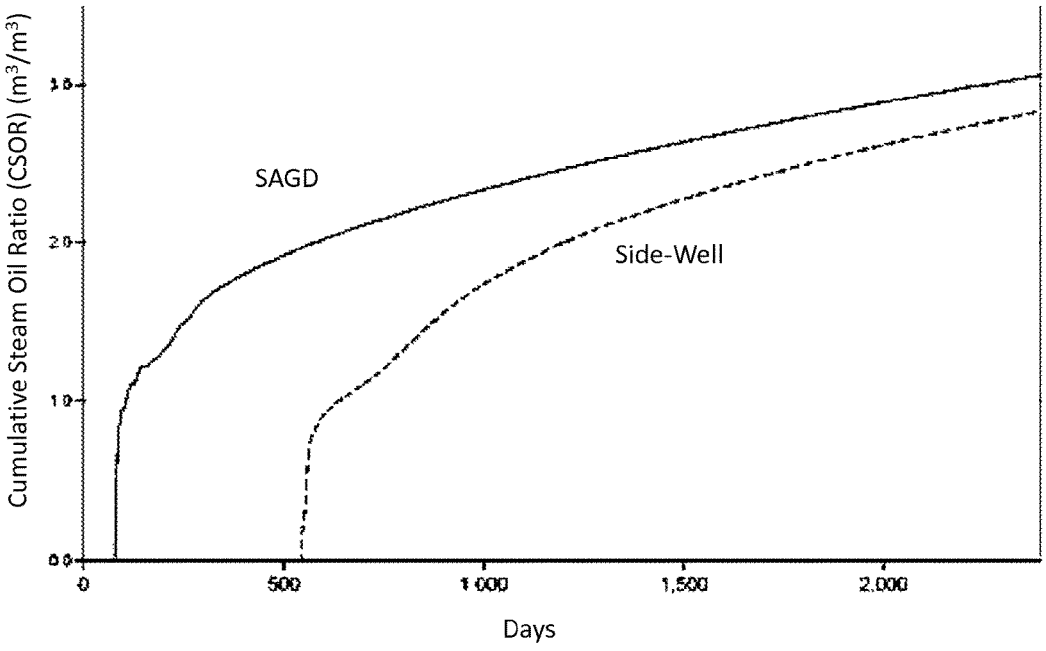
FIG. 3 is a graph showing simulated improvements in cumulative steam oil ratio utilizing the well pair configuration compared to a conventional SAGD pair with vertical offset between injection and production wells, according to one embodiment of the invention.

FIG. 3 shows reduction in simulated cumulative steam-oil ratio (CSOR) that results from utilizing side-well approaches described herein relative to conventional SAGD. Again, the side-well start time is offset 500 days after the SAGD start time for facilitating comparison. The CSOR during the first 1500 days for the side-well remains below that of the SAGD through the first 1500 days and is below 3.0.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method of producing hydrocarbons, comprising:
forming a single well pair comprising:
a single horizontal injection well in a formation, wherein the injection well comprises an injector section that extends lengthwise towards horizontal; and
a single production well comprising a producer section that extends lengthwise towards horizontal laterally offset and in horizontal alignment with the injector section;
introducing steam and a non-condensable gas under reservoir conditions into the formation through the injection well to form a steam-assisted gravity drainage chamber above the injector section; and
producing the hydrocarbons through the production well by combined steam-assisted gravity drainage and pressure drive from the gas;
wherein the injector section and the producer section are within 5 meters of a bottom of a heavy oil or bitumen reservoir that contains the hydrocarbons which have an initial API gravity less than 25° and the reservoir is less than 15 meters thick; and
wherein the injection well and the production well are separated from any other wells by more than 100 meters.

2. The method according to claim 1, wherein the gas is soluble in the hydrocarbons.

3. The method according to claim 1, wherein the gas is at least one of methane, propane and carbon dioxide.

4. The method according to claim 1, wherein the gas includes combustion products.

5. The method according to claim 1, wherein the reservoir is less than 10 meters thick.

6. The method according to claim 1, wherein the injector section and the producer section are parallel to one another on the same horizontal plane.

7. The method according to claim 1, wherein the injector section and the producer section are disposed between 5 and 15 meters from one another.

8. The method according to claim 1, wherein the injection well and the production well are configured to operate without the presence of additional wells.

9. The method according to claim 1, wherein the steam chamber extends over the production well.

10. The method according to claim 1, wherein the introducing of the steam occurs during the producing of the hydrocarbons.

11. A method of producing hydrocarbons, comprising:

forming a single well pair comprising:

a single horizontal injection well in a formation, wherein the injection well comprises a horizontal injector section; and a single production well comprising a producer section that extends parallel to the injector section on the same horizontal plane without vertical offset from the injector section;

introducing steam and a non-condensable gas under reservoir conditions into the formation through the injection well to form a steam-assisted gravity drainage chamber above the injector section; and producing the hydrocarbons through the production well by combined steam-assisted gravity drainage and pressure drive from the gas;

wherein the injector section and the producer section are within 5 meters of a bottom of a heavy oil or bitumen reservoir that contains the hydrocarbons which have an initial API gravity less than 25° and the reservoir is less than 15 meters thick; and wherein the injection well and the production well are separated from any other wells by more than 100 meters.

12. The method according to claim 11, wherein the gas is soluble in the hydrocarbons.

13. The method according to claim 11, wherein the gas is at least one of methane, propane and carbon dioxide.

14. The method according to claim 11, wherein the gas includes combustion gases from direct steam generation.

15. The method according to claim 11, wherein the reservoir is less than 10 meters thick.

16. The method according to claim 11, wherein the injector section and the producer section are disposed within 10 meters of one another.

17. The method according to claim 11, wherein the injection well and the production well are configured to operate without the presence of additional wells.

18. The method according to claim 11, wherein the introducing of the steam occurs during the producing of the hydrocarbons.

* * * * *